US006189968B1

(12) United States Patent
Emanuel et al.

(10) Patent No.: US 6,189,968 B1
(45) Date of Patent: Feb. 20, 2001

(54) LOUNGE AND CHAIR SAVER

(76) Inventors: Richard A. Emanuel, 46 Pine Tree Rd.; John J. Torre, 24 O'Neill Cir., both of Monroe, NY (US) 10950

( * ) Notice: Under 35 U.S.C. 154(b), the term of this patent shall be extended for 0 days.

(21) Appl. No.: 09/094,518

(22) Filed: Jun. 15, 1998

(51) Int. Cl.[7] ..... A47C 31/11

(52) U.S. Cl. ..... 297/188.01; 40/320; 40/727; 40/665; 297/228.11; 297/188.2

(58) Field of Search ..... 40/320, 727, 665; 24/442; 297/228.11, 228.13, 220, 188.01, 188.2, 228.12

(56) References Cited

U.S. PATENT DOCUMENTS

| | | | | |
|---|---|---|---|---|
| 2,203,155 | * | 6/1940 | Jullien et al. | 40/665 |
| 3,586,220 | * | 6/1971 | Reinsberg | 40/665 |
| 4,864,698 | * | 9/1989 | Brame | 24/442 |
| 5,400,936 | * | 3/1995 | Jones et al. | 40/904 |
| 5,785,381 | * | 7/1998 | Carter | 297/228.12 |

* cited by examiner

*Primary Examiner*—Cassandra H. Davis

(74) *Attorney, Agent, or Firm*—Michael Zall

(57) ABSTRACT

A device for use on a back or seat of a chair to provide an indicia that such chair is in use when a person is not seated in the chair. The device includes an elongated foldable web having a first and second end, the length of such foldable web being sufficient to wrap around the width of the seat or back of the chair. Preferably, an adjustable attachment is provided on at least one end of the foldable web for adjustably attaching such one end to the other end of the foldable web. The attachment is a VELCRO type hook and pile attachment. The foldable web may also include indicia removably attached to the foldable web, e.g., a business card, such indicia indicating that the seat is reserved. The foldable web may be securely wrapped around the back or seat of a chair to reserve the chair when it is not in use.

In another embodiment, the device is a continuous elastic elongated foldable web, the length of such foldable web being sufficient to tightly wrap around the width of the seat or back of the chair. The device preferably includes indicia removably attached to the foldable web, such indicia for indicating that the seat is reserved. The foldable web may be placed around the back or seat of a chair, the elastic foldable web sufficiently tight to securely wrap the foldable web around the back or seat and the indicia means indicating that the seat is reserved.

2 Claims, 5 Drawing Sheets

LOUNGE AND CHAIR SAVER

BACKGROUND OF THE INVENTION

This invention relates to an apparatus for reserving a lounge or seat, for example, in a theater or at the beach or pool side. More particularly, this invention is directed to a device that can be easily kept in a persons pocket or handbag when not in use and when needed can be unfolded for placement on the seat or lounge to reserve it for the person when he is not using the seat or lounge.

When a person goes to the beach or pool side, or attends a theatrical event, he often leaves the seat or lounge, to get, for example, refreshments, make a telephone call, etc. It is often difficult to continue to reserve this seat, particularly if a person is alone. Often the personal belongings of the person are placed over or in the seat. For, example a beach a towel may be placed on a lounge. This can be confusing to others, for they may think the person has abandoned the seat and left his hotel towel behind. Additionally, it is risky to leave your personal belongings behind because they may be stolen.

There have been some attempts to solve this problem. For example, U.S. Pat. No. 5,462,005 to Finger describes a relatively complicated apparatus for reserving seats that includes a complicated casing that encloses a tape that can be looped over the armrests. Indicia can be placed on the seat to indicate it is reserved. Such a device is bulky and complicated and is complex to use and bulky to carry, for example, at the beach.

Another device designed for reserving seats is described in U.S. Pat. No. 3,283,433 to Navarino. This device comprises a pair of hooks at the end of a stretchable strap that hook onto to the seat. The device has an identifying number to temporarily mark the seat.

Other patents possibly related prior art are U.S. Pat. No. 362,758 to Martin U.S. Pat. No. 521,990 to Root, U.S. Pat. No. 1,304,753 to Dwyer, U.S. Pat. No. 1,612,574 to Golden, U.S. Pat. No. 1,678,691 to De La Cuesta, U.S. Pat. No. 2,626,653 to Van Wyck, U.S. Pat. No. 3,635,523 to Alpert, U.S. Pat. No. 4,305,216 to Skelton, U.S. Pat. No. 4,955,153 to Albrecht and U.S. Pat. No. 5,407,167 to Michaelis. None of these references, however, teach or suggest applicants invention and the benefits derived therefrom.

OBJECTS AND SUMMARY OF INVENTION

It is an object of this invention to provide an improved device for reserving a seat or lounge when it has been temporarily vacated.

It is a further object of this invention to provide an improved device for reserving a lounge or seat that clearly indicates it is reserved and by whom.

It is yet a further object of this invention to provide a device for reserving seats that may be concealed on a person and unfolded for use.

It is yet a further object of this invention to provide a device for reserving the seat or lounge wherein a persons business card, room indicia or other identifying indicia may be removably attached to the device.

These and other objects of this invention are achieved by a device for use on a back or seat of a chair to provide an indicia that such chair is in use when a person is not seated in the chair. A preferred device includes an elongated foldable web having a first and second end, the length of such foldable web being sufficient to wrap around the width of the seat or back of the chair. An adjustable attachment means is provided on at least one end of the foldable web for adjustably attaching such one end to the other end of the foldable web. A preferred means is a VELCRO type hook and pile attachment means. Preferably, the web also includes a means for removably attaching an indicia means to the web, e.g., a business card, such indicia means indicating that the seat is reserved. The foldable web may be securely wrapped around the back or seat of a chair to reserve the chair when it is not in use.

In another embodiment, the device is a continuous elastic elongated foldable web, the length of such foldable web being sufficient to tightly wrap around the width of the seat or back of the chair. The device also includes an indicia means for indicating that the seat is reserved. Preferably, the indicia means is removably attached to the web. The foldable web may be placed around the back or seat of a chair, the elastic web sufficiently tight to securely wrap the foldable web around the back or seat and the indicia means indicating that the seat is reserved.

BRIEF DESCRIPTION OF THE DRAWINGS

These and other significant features of the present invention will be more clearly understood by reference to the following description of preferred embodiments of the invention, taken in conjunction with the accompanying drawings, in which.

DETAILED DESCRIPTION

Figure 1:
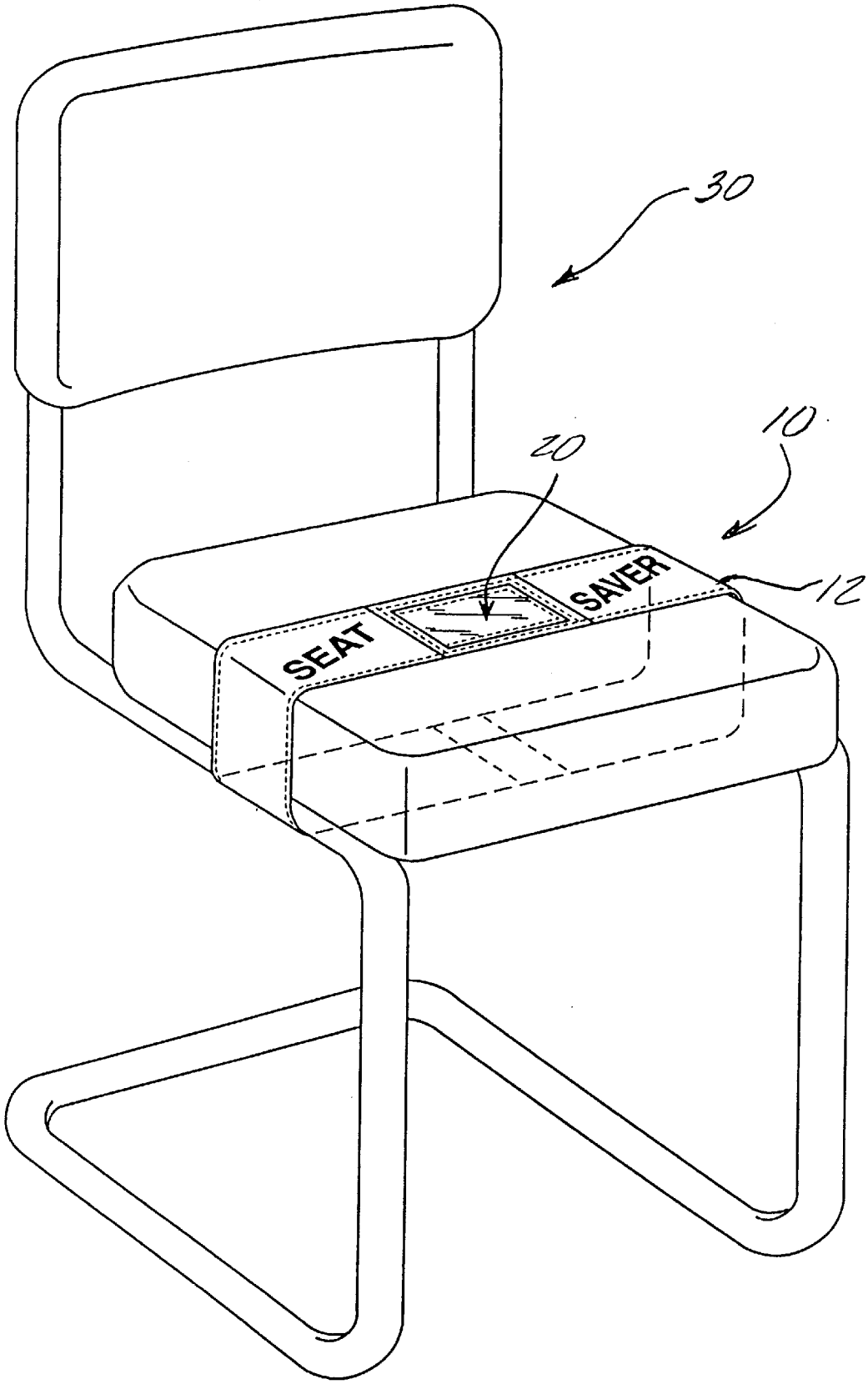
FIG. 1 is a perspective drawing of one embodiment of the seat saver of this invention in use on, for example, a restaurant chair.

Referring to FIGS. 1–4, the device of this invention 10 is for use on a back or seat of a chair 30. By the use of the term "chair" it is meant any type device upon which a person may sit or recline. It includes, but is not limited to the chair 30 depicted in FIG. 1 and the lounge chair 50 depicted in FIG. 7. It may also include chairlike devices not depicted herein, e.g., theater chairs, stadium chairs, park benches, airline seats, bus seats, etc.

The device 10 of this invention is used to provide an indicia that such chair is in use when a person is not seated in the chair. For example, it may be used on theater seats by the management to indicate that the seat is reserved for a particular person or can be used by a person when he leaves the seat, for example, to go to the restroom. Again as examples, it may be used at resorts to reserve a particular lounge, in an airline when the passenger wants to get off the plane at a stop, etc.

In a preferred embodiment, the device 10 comprises an elongated foldable web 12. The foldable web 12 may be made of a waterproof fabric or an "elegant" fabric depending on its intended market. For example if used at a resort the foldable web 12 should be made of a weather resistant, waterproof fabric. If on the other hand, the device 10 is intended for use at the opera the foldable web 12 may, for example, be constructed of a dry-cleanable velvet fabric. The foldable web 12 has a first end 12*a* and second end 12*b*. The length of such foldable web 12 should be selected such that it is sufficient to wrap around the width of the seat or back of the chair 30 when the ends 12*a*, 12*b* are connected to each other, see for example FIG. 1.

Still referring to FIGS. 1–4, an adjustable attachment means is on at least one end of the foldable web 12 for adjustably attaching such one end to the other end of the foldable web 12. In the preferred embodiment, the end 12*a* has stitched or glued thereon a VELCRO type pile section 16 and the other end 12*b* has stitched or glued thereon a VELCRO type mating hook section 14. It should be realized however that any type adjustable attachment means may be used, for example snaps, buttons, ties, etc., as long as it can secure the ends 12*a*,12*b* together and provide adjustment of the foldable web 12 to the various size seats and backs that exist on chairs. It has been found that VELCRO type fastening means are the most convenient to use and construct.

Figure 2:
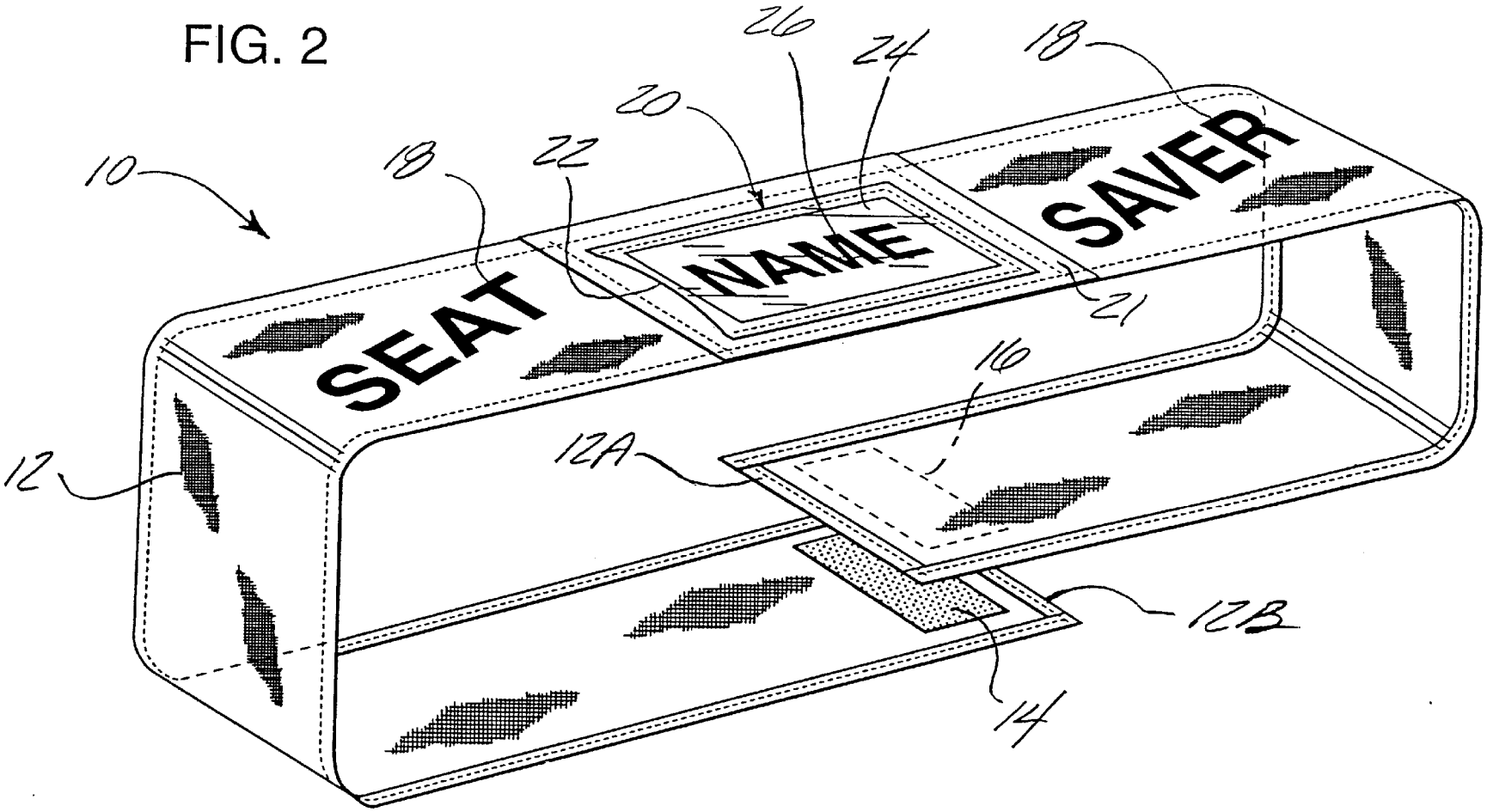
FIG. 2 is a schematic perspective view of the seat saver of this invention shown in FIG. 1, just prior to placement and securement on a seat.
Figure 3:
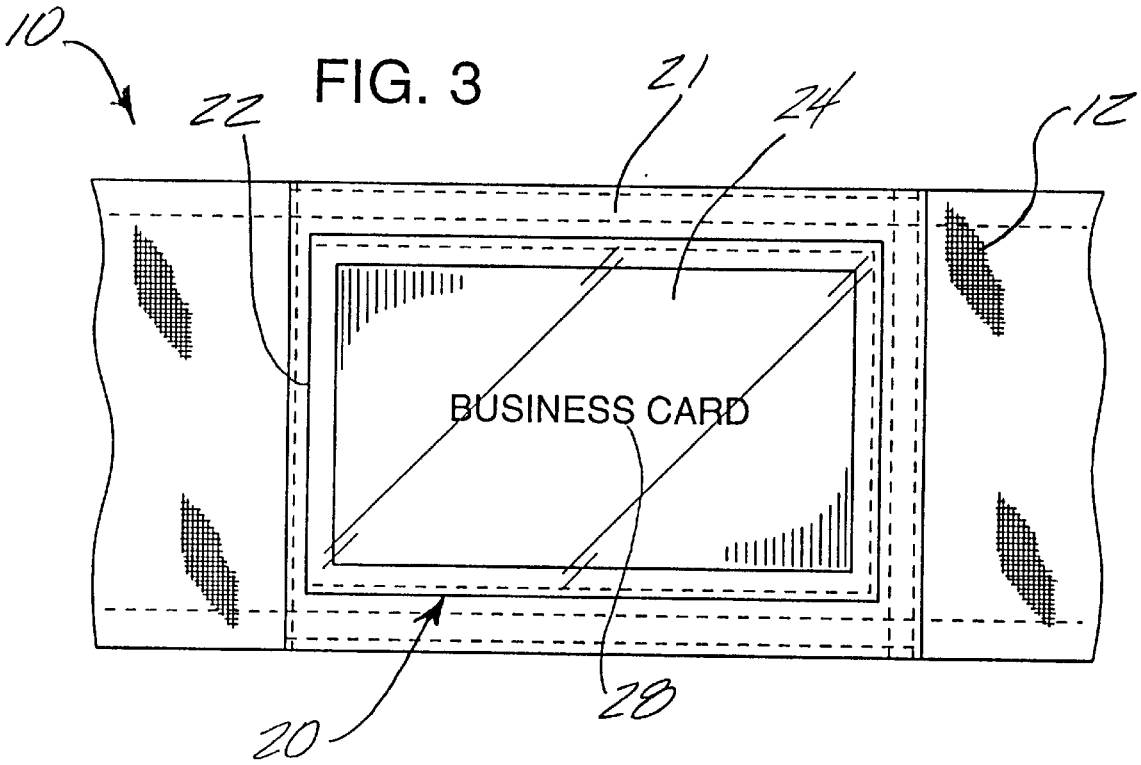
FIG. 3 is a top view of the pocket on the seat saver for placement of, for example, a persons business card therein.
Figure 4:
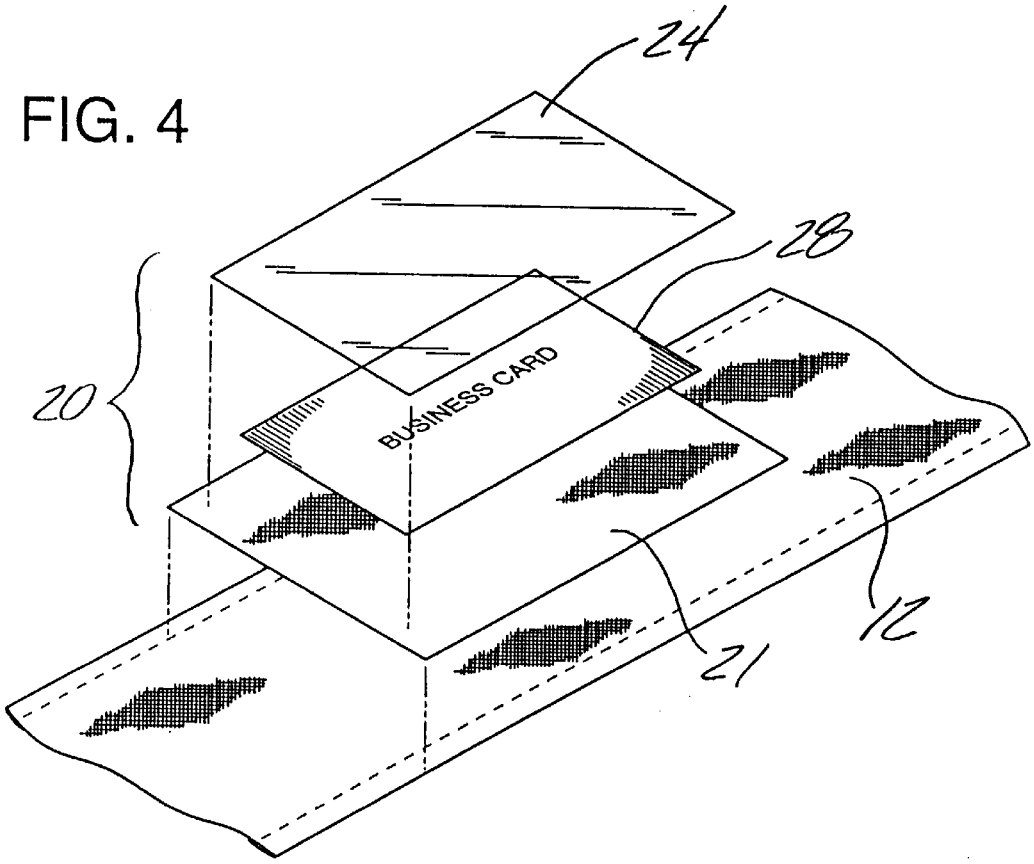
FIG. 4 is a perspective schematic of the pocket shown in FIG. 3 showing the elements thereof.

A means is provided for removably attaching an indicia means 18 to the web. The indicia means 18 is used for indicating that the chair 30 is reserved. Referring to FIGS. 2–4, a preferred means for removably attaching an indicia 18 means to the web 12 comprises a pocket 20 attached to the web 12. In a preferred embodiment, the pocket 20 includes a fabric backing 21 that is secured to the web 12 through stitching or gluing. Overlying the backing 21 is clear or transparent plastic sheet 24 that is stitched to the backing on three sides to provide an opening between the backing 21 and the transparent plastic sheet 24. This allows for the placement of an indicia card 28, there between. The card 28 may be a business card, a "reserved" logo, a room number, a seat number, etc. This removable indicia means 28 is inserted through the opening in the pocket 20 and is viewable through the transparent plastic face 24 to indicate that the seat is reserved.

Figure 5:
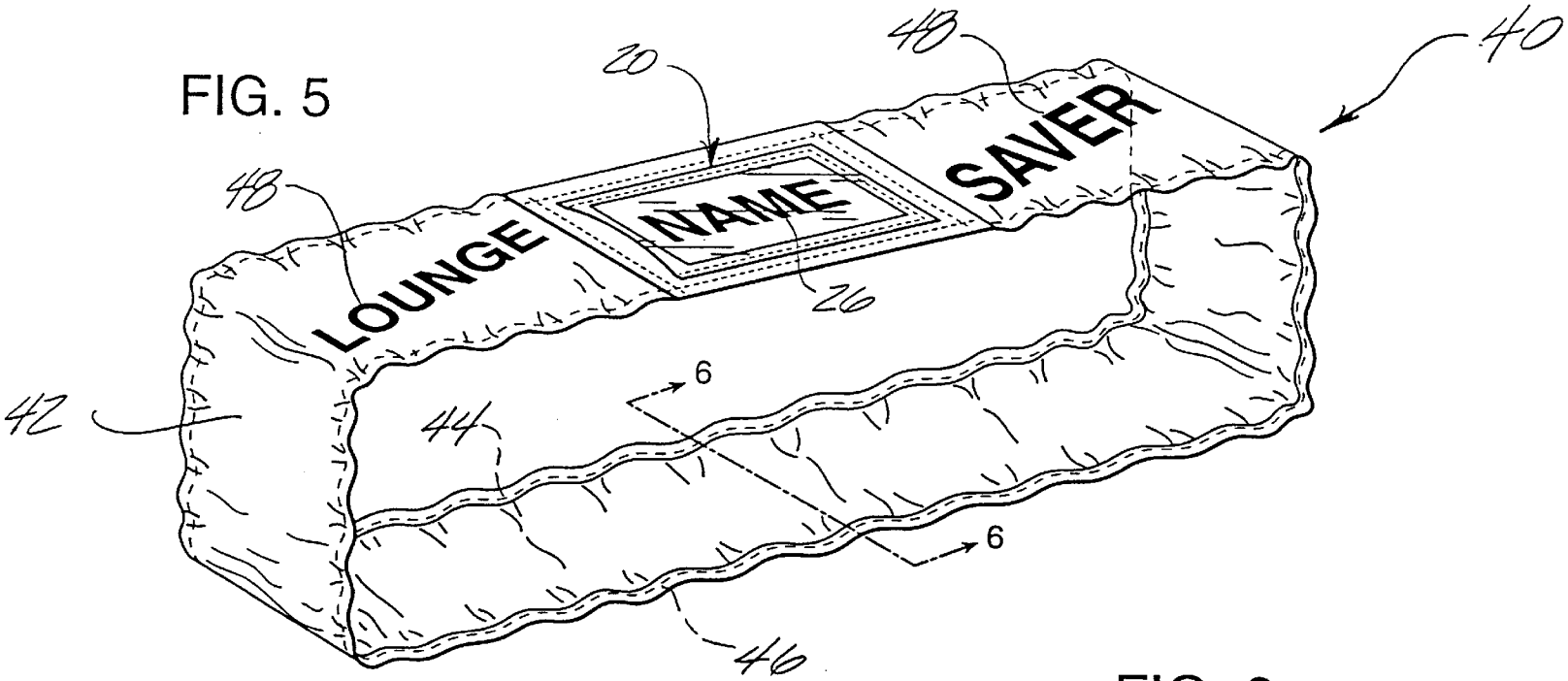
FIG. 5 is a perspective view of another embodiment of the seat saver of this invention.
Figure 6:
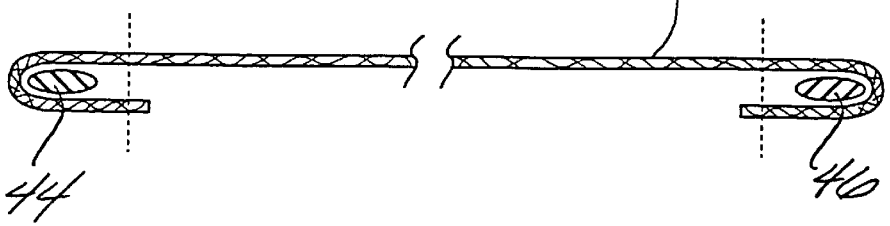
FIG. 6 is a cross-section of a portion of the seat saver of FIG. 5 along 6—6 of FIG. 5.
Figure 7:
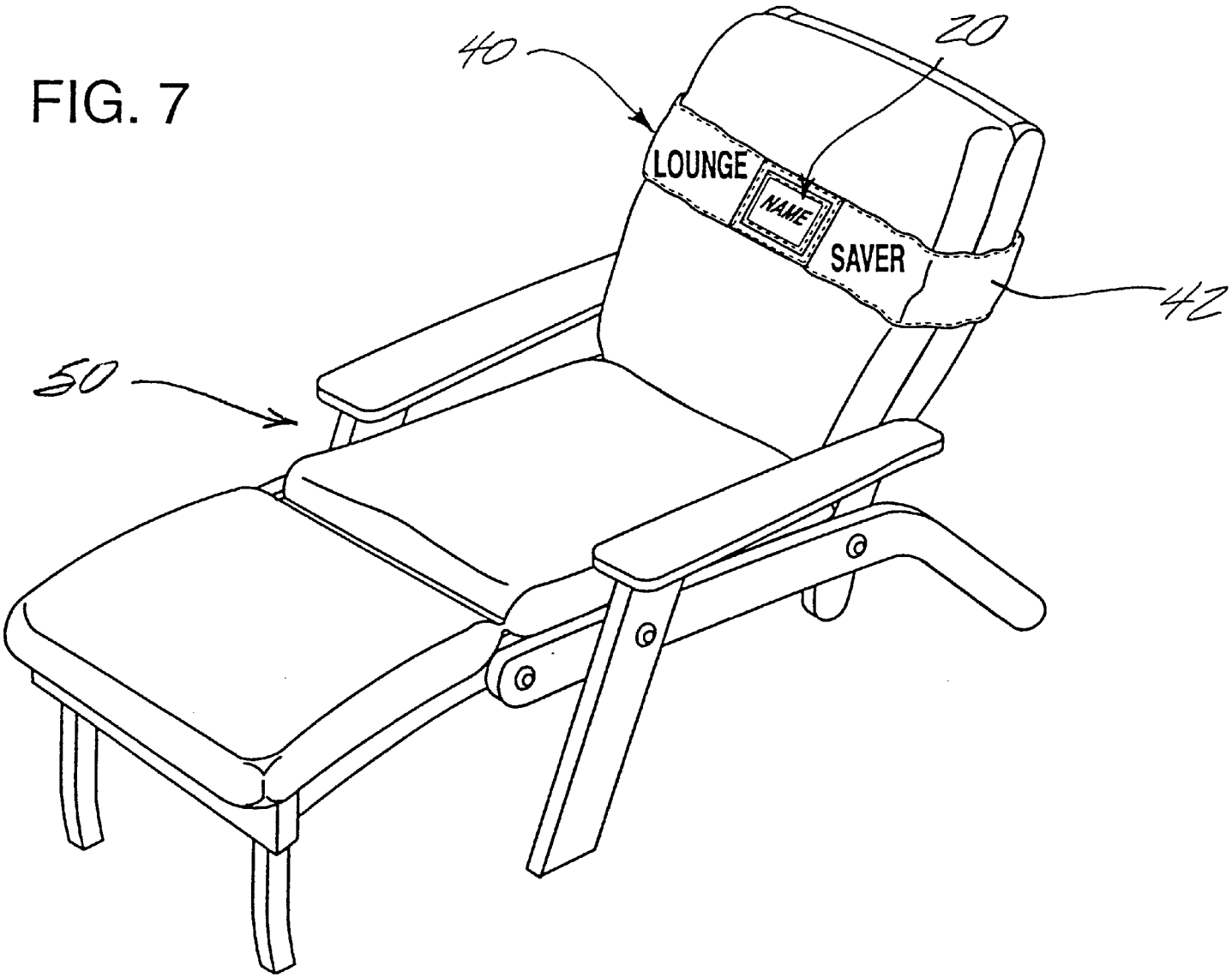
FIG. 7 is a perspective view showing the seat saver of FIGS. 5 and 6 in use on a lounge.

Referring to FIGS. 5–7, another embodiment of the device 40 is depicted. The device 40 comprises a continuous elastic elongated foldable web 42. The length of such foldable web 42 is sufficient to tightly wrap around the width of the seat or back of the chair or lounge 50, see FIG. 7. In the embodiment depicted in FIGS. 5 and 6, the foldable web 42 comprises elongated elastic bands 44,46 stitched along the edges of the foldable web 42 to provide the appropriate elasticity. Optionally, the foldable web 42 can be of an elastic material. In this embodiment, the web 42 also has a similar means for removably attaching an indicia means for indicating that the seat is reserved 20. The web 42 may also have or only have thereon a logo 48 to indicate the trademark of the inventive device, the resort hotel, the airline, the theater, etc. or an indicia indicating that the seat is reserved.

To use the device 40, the foldable web 42 is placed around the back or seat of a chair 50. The elastic web 42 is sufficiently tight to be securely wrapped around the back or seat of the lounge 50, with the indicia means 20 indicating that the seat is reserved.

What is claimed is:

1. A combination comprising a chair having a seat and back and a device for use on the back of the chair or the seat of the chair to provide an indicia that the chair is in use when a person is not seated in the chair, the device comprising:

an elongated foldable web having a first and second end, the length of such foldable web being sufficient to wrap around the width of the seat or back of the chair;

an adjustable attachment means on at least one end of the foldable web for adjustably attaching such one end to the other end of the foldable web, wherein the adjustable attachment means comprises mating hook and pile attachment means attached to the first and second ends;

a means for removably attaching an indicia means to the foldable web, comprising a pocket attached to the foldable web, the pocket having an opening and a transparent face and a removable indicia means inserted through the opening in the pocket viewable through the transparent face to indicate that the seat is reserved;

the foldable web wrapped around the back or seat of a chair, the attachment means on the one end attached to the other end and adjusted to securely wrap the foldable web around the back or seat and the indicia means indicating that the seat is reserved and in a position that when a person sits on the chair the web remains between the persons and the chair.

2. A combination comprising a chair having a seat and back and a device for use on the back of the chair or the seat of the chair to provide an indicia that the chair is in use when a person is not seated in the chair, the device comprising:

a continuous elastic elongated foldable web, the length of such foldable web being sufficient to tightly wrap around the width of the seat or back of the chair;

a means for removably attaching an indicia means to the foldable web, comprising a pocket attached to the foldable web, the pocket having an opening and a transparent face, and a removable indicia means inserted through the opening in the pocket viewable through the transparent face to indicate that the seat is reserved;

the foldable web placed around the back or seat of a chair, the elastic foldable web sufficiently tight to securely wrap the foldable web around the back or seat and the indicia means indicating that the seat is reserved.

* * * * *